United States Patent [19]

Cherry et al.

[11] 4,405,195

[45] Sep. 20, 1983

[54] PIN AND SOCKET CONNECTOR

[75] Inventors: Hitesh Cherry, Harrisburg; Arthur L. Mueller, Camp Hill; Walter M. Werner, Downingtown, all of Pa.

[73] Assignee: AMP Incorporated, Harrisburg, Pa.

[21] Appl. No.: 258,710

[22] Filed: Apr. 29, 1981

[51] Int. Cl.[3] ..... H01R 11/22

[52] U.S. Cl. ..... 339/252 R

[58] Field of Search ..... 339/91 R, 217 R, 217 S, 339/251, 252 R, 252 P, 252 S, 253 S, 255 RT, 256 RT, 267, 273 R, 273 F

[56] References Cited

U.S. PATENT DOCUMENTS

| | | | |
|---|---|---|---|
| 2,999,221 | 9/1961 | Ellis et al. | 339/217 S |
| 3,122,408 | 2/1964 | Laszczewski | 339/273 F |
| 3,478,305 | 11/1969 | Chirumbolo | 339/217 S |

FOREIGN PATENT DOCUMENTS

| | | | |
|---|---|---|---|
| 426259 | 3/1935 | United Kingdom | 339/267 |

*Primary Examiner*—Eugene F. Desmond
*Assistant Examiner*—David Pirlot
*Attorney, Agent, or Firm*—Allan B. Osborne

[57] ABSTRACT

The invention disclosed herein is a pin and socket connector having a high resistance to tensile or pull-out forces. The pin includes three separate spring beams which are joined together to form an expandable insertion member. The socket includes a receptacle with means therein to expand the insertion member outwardly to achieve good electrical contact. Cooperating locking means on the pin and socket prevent separation of the two.

4 Claims, 5 Drawing Figures

PIN AND SOCKET CONNECTOR

BACKGROUND OF THE INVENTION

1. The Field of the Invention

The invention disclosed herein relates to electrical pin and socket type connectors for joining high voltage carrying cable. More specifically, the present invention relates to pin and socket connectors that have locking means to prevent separation.

2. The Prior Art

Prior art and contemporary pin and socket connectors are exemplified by the COPALUM Welding Cable Disconnects sold by AMP Incorporated of Harrisburg, Pa. These type connectors have a pin split into two spring beams so that upon being inserted into the socket, the beams are compressed to effect a good electrical contact. A lug in the socket engages a groove on the pin to releasably lock the two together.

SUMMARY OF THE INVENTION

The preferred embodiment constructed in accordance with the present invention includes a pin which is composed of three, parallel members with the rear sections secured in a tubular housing. The socket has a receptacle in which is positioned a frusto-conical shaped member which forces the members outwardly as the pin is inserted therein. A compressible ring on the pin is received in a groove in the receptacle so that the pin cannot be withdrawn.

BRIEF DESCRIPTION OF THE DRAWINGS

FIG. 3 is a cross-sectional view of the pin and socket of FIG. 1 after being joined together.

DESCRIPTION OF THE INVENTION

Figure 1:
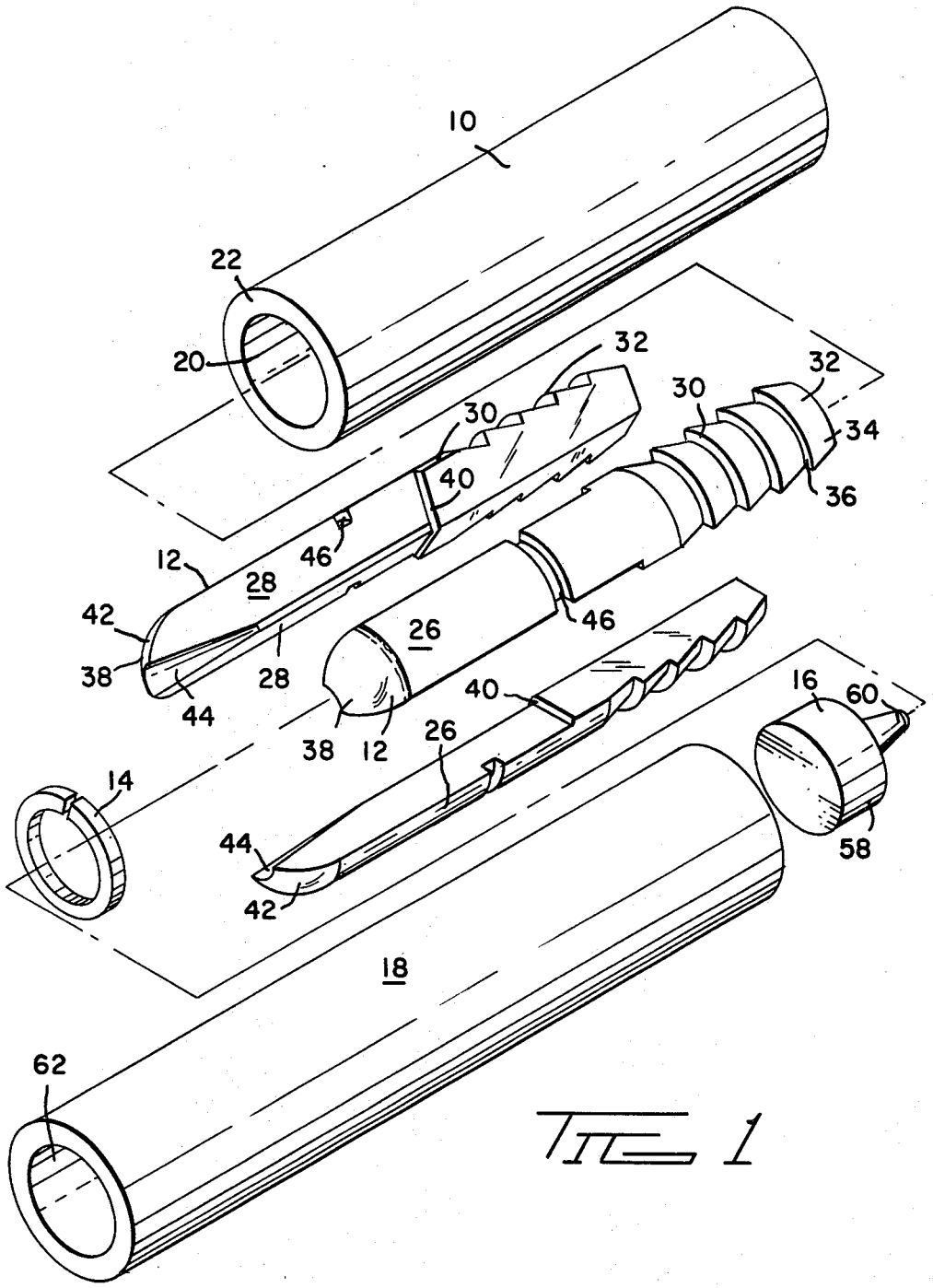
FIG. 1 is a perspective, exploded view of the preferred embodiment of the pin and socket of the present invention.

The several components of the pin and socket of the preferred embodiment of the present invention is shown in FIG. 1. The pin components include pin housing 10, three spring members 12, and a compressible, split retaining ring 14. The two socket components are the expander 16 and socket housing 18.

Pin housing 10 is made from 6061 aluminum or copper alloy. A passage 20 extends completely through it with one end 22 receiving spring members 12 and the other end 24 receiving a bared end of a cable (not shown).

Spring members 12 are made from 380A aluminum or copper alloy. The outer surface 26 of each member is curved, describing an arc of 120 degrees. The inside consists of two flat surfaces 28 each being at an angle relative to the other. The outer surface of rear section 30 of each member has a number of saw tooth-like structures, indicated by reference numeral 32. The beveled portion 34 of each structure faces rearwardly and the vertical step or shoulder 36 faces forwardly towards the leading end 38 of the beam. The rear section extends forwardly to a change in thickness which is indicated by forwardly facing shoulder 40.

The free end 38 of each member has a rounded nose 42 from which an arcuate channel 44 extends inwardly on the inside; i.e., between the two flat surfaces. In channel converges inwardly. Finally, a groove 46 extends across the outer curved surface of each member just forwardly of the rear section.

Figure 2:
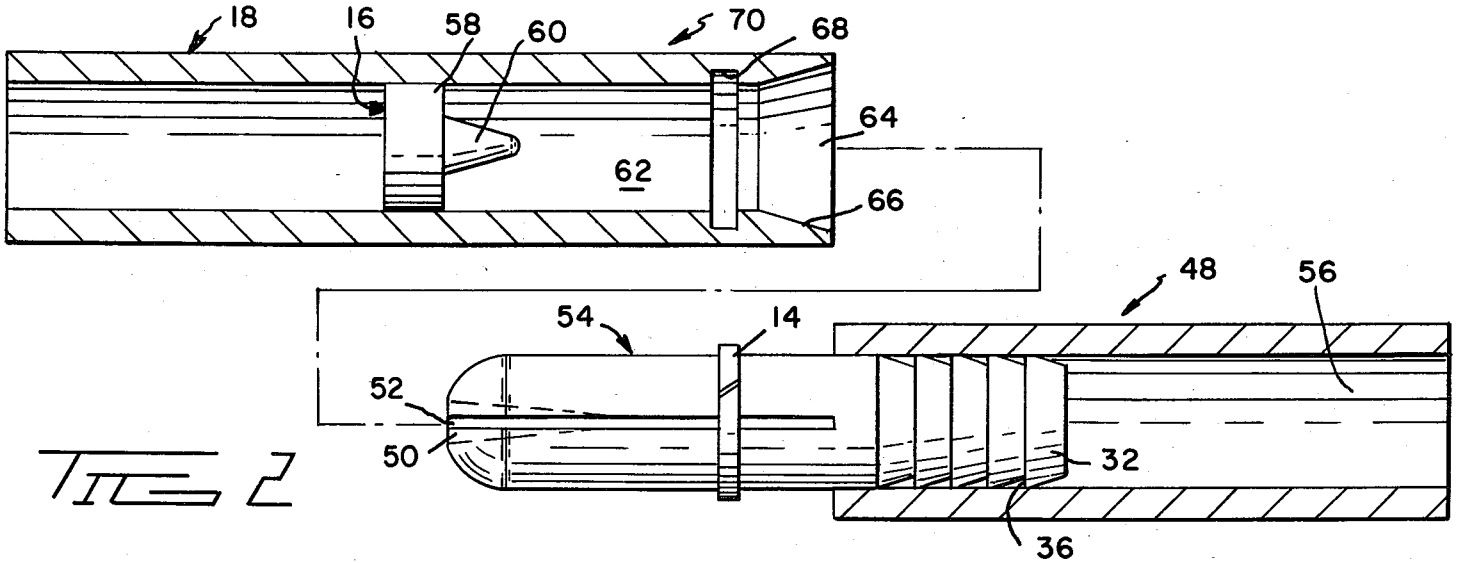
FIG. 2 is a cross-sectional view of the assembled pin and socket of FIG. 1.
Figure 7:
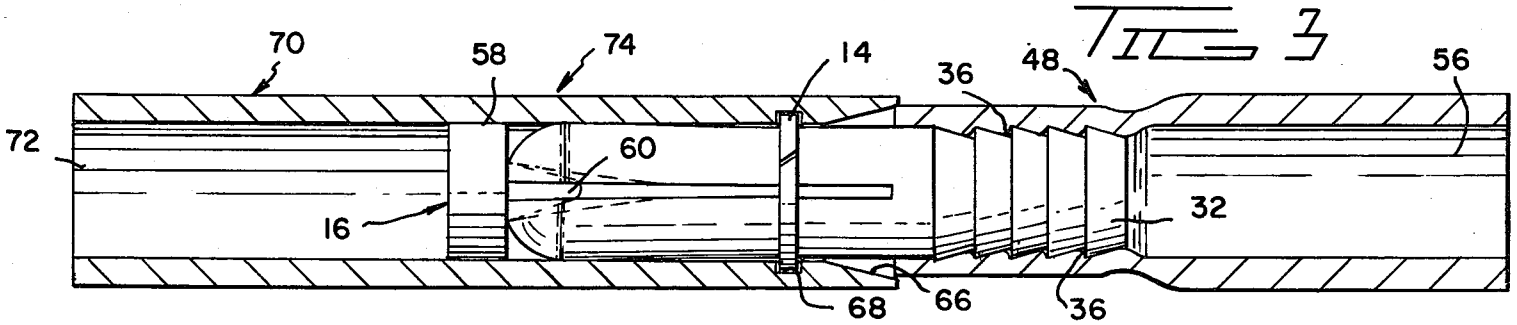

In assembling the pin components to form pin 48 shown in FIGS. 2 and 3, the three spring members are brought together with the flat surfaces 28 on the rear section 30 in contact with the flat surfaces 28 on adjacent members. The arcuate channels 44 together define a frusto-conical opening 50 (FIG. 2). The flat surfaces on the portions forward of shoulders 40 do not meet so that a slot 52 (FIG. 2) is defined. The portions of the three spring members forwardly of shoulder 40 cooperatively form the insertion means of pin 48.

The rear sections of the three members are inserted into end 22 of passage 20 in pin housing 10 and secured therein by swaging. The compressible or split retaining ring 14 is then placed in grooves 46. FIG. 3 shows the housing pressed down around the rear section with metal therefrom filling the spaces between the saw tooth structures. The resulting pin 48 may now be considered as an integral assembly having insertion means 54 and a cable-receiving end 56. A bared end of a cable (not shown) is inserted into end 56 and secured therein by conventional crimping or soldering techniques.

Expander 16, one of the two socket components, has a base 58 of substantial thickness and on which is positioned a cone 60 having a frustro-conical shape. The expander is preferably made from 2024 T 3 aluminum alloy or 380A aluminum or copper alloy.

With specific reference to FIG. 2, socket housing 18, made from either 6061 aluminum or copper alloy, has a passage 62 extending longitudinally therethrough with the front portion constituting a receptacle to receive the insertion means of the pin. The receptacle portion is slightly larger than insertion means 54 of pin 48 and slightly smaller than base 58 of expander 16. Opening 64 to the receptacle is tapered inwardly as indicated by reference numeral 66. A retaining ring-receiving groove 68 is located in the wall defining passage 62 just back to the tapered opening.

Socket 70 is formed by driving the expander into passage 62 with cone 60 facing opening 62. The fit is frictional although other means for securing the expander in the passage may be used. The socket has a cable-receiving end 72 opposite opening 64. As with pin 48, a bared cable end (not shown) is inserted into end 72 and secured therein by crimping or soldering.

FIGS. 2 and 3 show electrical connection 74 made by joining pin 48 and socket 70. Once joined, the connection, for all practical purposes, is permanent. An insertion means 54 is inserted into passage 62 through opening 64, the frustro-conical opening 50 in the nose of the mating end slides over cone 60. As the opening slides further onto the cone, the three spring members 12 are spread or forced outwardly. Continued mating pressure on the pin and socket causes a further expansion of the beams. As the mating end is being inserted into the socket, compressible ring 14 engages the tapered opening and is compressed sufficiently to pass through the passage 64 to groove 68. Upon reaching the groove, the ring expands into it and thereby locks the pin and socket together.

Figure 4:
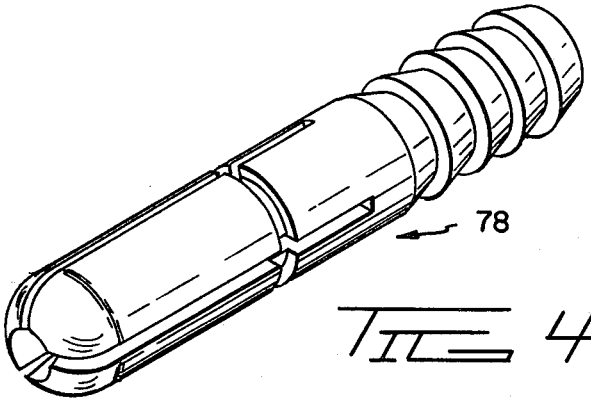
FIGS. 4 and 5 are perspective views of a second embodiment of the pin of the present invention.

FIG. 4 shows an alternative embodiment of a pin. Rather than having three separate spring members, a one-piece component, designated by reference numeral 78, is milled from tubular stock (not shown). The preferred material would be aluminum or copper alloy.

Figure 5:
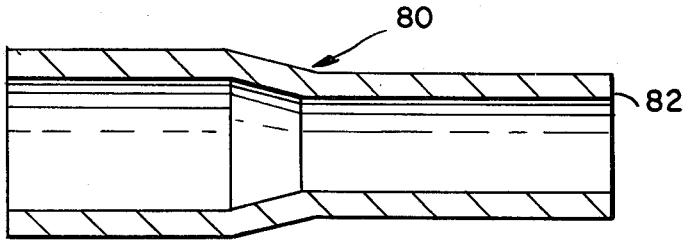

The pin housing shown in FIG. 5 and indicated by reference numeral 80, has to be cold-drawn to reduce cable-receiving end 82. This modified end will accept a smaller range of cable.

Throughout the above description, reference to two different materials, aluminum and copper alloy, was made. As is well known to the art, aluminum would be the preferred material where the cable is aluminum. Copper alloy would be preferred for use with copper cable.

The present invention may be subject to many modifications and changes without departing from the spirit or essential characteristics thereof. The present embodiment is therefore intended in all respects as being illustrative and not restrictive of the scope of the invention.

What is claimed is:

1. A pin and socket connector of the type formed by the pin being telescopingly received in the socket, said connector comprising:

a. a elongated pin of conductive material having cable receiving means at one end and cylindrical socket insertion means comprising a plurality of spring beams at the opposite end with the free ends of the beams collectively defining a tapered opening therebetween, and further, a groove encircling the circumference of the insertion means at a location spaced rearwardly from the free end thereof;

b. a compressible ring positioned in the groove with a portion of the ring extending above the surface of the pin when in a non-compressed state; and c. en elongated socket having cable receiving means at one end and a receptacle at the opposite end adapted to receive the insertion means of said pin with the wall of the receptacle having a circumferential groove opening out into the receptacle and further a cone-shaped member positioned in the receptacle so that upon inserting the insertion means into the receptacle the ring becomes compressed until reaching the groove whereupon it expands thereinto to lock the pin in the socket and the cone-shaped member enters the tapered opening and thereby causes said beams to expand outwardly against the wall of the receptacle.

2. The pin and socket connector of claim 1 wherein the insertion means include three separate elongated members, each member having a curved outer surface with a groove therein perpendicular to the length of the member and a pair of flat inside surfaces such that upon placing the members together, they cooperatively define a cylindrical shape with said groove being in aligned relation with the grooves in adjacent members.

3. The pin and socket connector of claim 2 wherein the rear sections of the elongated members are placed in and secured to a tubular member to form said pin.

4. The pin and socket connector of claim 3 wherein the opening to the receptacle in the socket is tapered to facilitate compressing the ring as the insertion means are inserted thereinto.

* * * * *